US007421216B2

(12) United States Patent
Onda et al.

(10) Patent No.: US 7,421,216 B2
(45) Date of Patent: Sep. 2, 2008

(54) DEVELOPMENT METHOD WITH CONTROLLED TONER DENSITY

(75) Inventors: Hiroshi Onda, Nara (JP); Syohji Tomita, Osaka (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 79 days.

(21) Appl. No.: 10/577,491

(22) PCT Filed: Oct. 29, 2004

(86) PCT No.: PCT/JP2004/016127

§ 371 (c)(1),
(2), (4) Date: Apr. 27, 2006

(87) PCT Pub. No.: WO2005/043253

PCT Pub. Date: May 12, 2005

(65) Prior Publication Data

US 2007/0058995 A1 Mar. 15, 2007

(30) Foreign Application Priority Data

Oct. 30, 2003 (JP) ..... 2003-370861

(51) Int. Cl.
*G03G 15/08* (2006.01)

(52) U.S. Cl. ..... 399/27

(58) Field of Classification Search ..... 399/27
See application file for complete search history.

(56) References Cited

U.S. PATENT DOCUMENTS 5,024,181 A * 6/1991 Shoji et al. ..... 399/167
5,624,778 A * 4/1997 Sato et al. ..... 430/111.35
5,688,622 A * 11/1997 Ito et al. ..... 430/122.4
6,157,798 A * 12/2000 Kawanishi et al. ..... 399/159
7,250,240 B2 * 7/2007 Tosaka et al. ..... 430/108.1
2003/0091372 A1 * 5/2003 Shigeta et al. ..... 399/267
2004/0197693 A1 * 10/2004 Ninomiya et al. ..... 430/108.7
2004/0253528 A1 * 12/2004 Yamashita et al. ..... 430/111.35

FOREIGN PATENT DOCUMENTS

JP 1-237577 A 9/1989
JP 8-190274 A 7/1996
JP 10-312105 11/1998
JP 11-73020 A 3/1999
JP 11-160914 6/1999
JP 11-198428 7/1999

(Continued)

OTHER PUBLICATIONS

International Search Report for PCT/JP2004/016127 dated Feb. 8, 2005.

*Primary Examiner*—Quana M Grainger
(74) *Attorney, Agent, or Firm*—Nixon & Vanderhye P.C.

(57) ABSTRACT

A target specified range of a toner density is correctly set so that a toner density is consistently appropriately controlled.

If a specified range within which a measured toner density TD (%) should fall is set based on an expression (2) below using a volume average diameter Dcav_vol (μm) of a magnetic carrier and a volume average diameter Dtav_vol (μm) of a toner, the target specified range can be correctly set, thereby making it possible to consistently appropriately control the toner density.

$$TD \leqq \{\gamma t \cdot Vt/Nt/(\gamma c \cdot Vc)\} \times 100 \quad (2)$$

7 Claims, 9 Drawing Sheets

FOREIGN PATENT DOCUMENTS

| | | | |
|---|---|---|---|
| JP | 2000-305355 | A | 11/2000 |
| JP | 2001-265116 | | 9/2001 |
| JP | 2003-162090 | | 6/2003 |
| JP | 2003-167395 | A | 6/2003 |
| JP | 2003-167441 | A | 6/2003 |
| JP | 2003-186297 | A | 7/2003 |
| JP | 2003-270947 | A | 9/2003 |

* cited by examiner (a)

FIG.6

| | actually measured values | | |
|---|---|---|---|
| TD | fog BG | ID bk | excess toner |
| 4.0% | 0.84 | 1.29 | 0.0% |
| 5.0% | 0.87 | - | 0.0% |
| 5.6% | 0.94 | 1.4 | 0.0% |
| 6.0% | 1.42 | - | 0.4% |

FIG.7

| | | TD | | | |
|---|---|---|---|---|---|
| | | Dt50_voL | Dtav_voL | Dtav_pop | Dt50_pop |
| | | 6.71 | 5.52 | 4.81 | 4.41 |
| Dc50_pop | 39.7 | 8.39% | 6.55% | 5.53% | 4.99% |
| Dcav_pop | 42.0 | 7.78% | 6.09% | 5.15% | 4.65% |
| Dcav_voL | 45.1 | 7.11% | 5.58% | 4.73% | 4.27% |
| Dc50_voL | 48.1 | 6.56% | 5.58% | 4.38% | 3.97% |

unit of diameter: $\mu$m

DEVELOPMENT METHOD WITH CONTROLLED TONER DENSITY

This application is the U.S. national phase of international application PCT/JP2004/016127 filed 29 Oct. 2004 which designated the U.S. and claims priority to JP 2003-370861 filed 30 Oct. 2003, the entire contents of each of which are hereby incorporated by reference.

TECHNICAL FIELD

The present invention relates to a development method which is applied to an electrophotographic image forming apparatus and are used to control the toner density of a developer which is a mixture of a magnetic carrier and a toner while stirring the developer and supplying the toner of the developer to the image forming apparatus.

BACKGROUND ART

A conventional development apparatus of this type is disclosed in Patent Document 1, for example. The development apparatus is composed of a hopper 101 and a development section 102 as illustrated in FIG. 13. A toner 103 is held in the hopper 101, and is supplied through a supply outlet 105 to the development section 102 by rotation of a toner supply roller 104. A developer 106 in the development section 102 is a mixture of a magnetic carrier and a toner. The magnetic carrier and the toner are charged by friction as they are stirred by a stirring blade 107 (electric charge is provided to the magnetic carrier and the toner). A magnet roller 108 is composed of a rod-shaped magnet and a sleeve 108*a*. The magnet is fixed, and the sleeve 108*a*, which is made of a non-magnetic material (e.g., aluminum), is supported around the magnet in a manner which allows the sleeve 108*a* to freely rotate around the magnet. The developer is attracted by an outer circumferential surface of the rotating sleeve 108*a* due to the magnetic force of the magnet, and is transported by rotation of the sleeve 108*a* to a photosensitive body (not shown). A doctor blade 109 regulates a thickness of a developer layer on the outer circumferential surface of the sleeve 108*a* using an edge thereof.

When the toner in the developer layer on the outer circumferential surface of the sleeve 108*a* is charged by friction as the toner is stirred by the stirring blade 107, the charge of the toner has a polarity reverse to an electrostatic latent image on a surface of the photosensitive body, so that the toner is attached to the electrostatic latent image on the surface of the photosensitive body. Thereby, the electrostatic latent image on the surface of the photosensitive body becomes a visible image.

When a transport amount of the developer 106 is large, an excess amount thereof flows between a toner density sensor 110 and a bent portion 111*a* of a guide plate 111, slides down on the upper surface of the guide plate 111, and is returned to the stirring blade 107.

The toner density sensor 110 detects a toner density of the developer. As the toner of the developer is supplied to the photosensitive body, the toner density of the developer decreases. Therefore, the toner 103 is supplied from the hopper 101 to the development section 102 by the toner supply roller 104 so that the toner density detected by the toner density sensor 110 falls within a specified range.

However, even when actual measurement of the toner density is correct, the toner density of the developer is always inappropriate if there is an error in the specified range of the toner density, so that a faint image, a fog image, or the like occurs.

Therefore, for example, in Patent Document 2, the toner density is set so that Tn is 130 (%) or less, where Tn is a covering ratio of the toner to a surface of the magnetic carrier and the covering ratio Tn is defined by an expression below. In other words, a specified range of the toner density which causes the covering ratio Tn to be 130 (%) is set, and the toner density of the developer is caused to fall within the specified range.

$$Tn=100C\sqrt{3}/\{2\pi(100\cdot C)\cdot(1+r/R)^2\}\cdot(r/R)\cdot(\rho t/\rho c)]$$

where r is a radius of the toner (μm), R is a radius of the magnetic carrier (μm), ρt is an absolute specific gravity of the toner (g/cm$^3$), and ρc is an absolute specific gravity of the magnetic carrier (g/cm$^3$).

Note that other patent documents also disclose a technique of setting a specified range of toner density using a diameter of a toner and a diameter of a magnetic carrier.

[Patent Document 1] JP H1-237577A

[Patent Document 2] JP H10-312105A

DISCLOSURE OF INVENTION

Problem to be Solved by the Invention

As a toner diameter and a magnetic carrier diameter, average values are used. Examples of a method of determining an average diameter of a toner and an average diameter of a magnetic carrier include number average diameter, volume average diameter, number median diameter, volume median diameter, and the like (see, for example, JIS8819-2, JIS8101-1, etc.).

However, according to studies conducted by the present inventor(s) and the like, it was found that, even if the number average diameter, volume average diameter, number median diameter, and volume median diameter of the same toner or magnetic carrier are measured using respective procedures, these measured diameters are different from each other despite the same toner or magnetic carrier.

Therefore, even if a specified toner density range is set using an average diameter of a toner and an average diameter of a magnetic carrier as in conventional technology, the specified range is not necessarily correct, so that there is a problem with reproducibility of appropriate control of toner density.

In view of the above-described conventional problem, an object of the present invention is to provide a development method capable of consistently appropriately controlling toner density by correctly setting a target specified toner density range.

Means for Solving Problem

In order to solve the above-described problem, the present invention provides a development method in which, while stirring a developer which is a mixture of a magnetic carrier and a toner and supplying the toner of the developer, a toner density TD (%) of the developer is measured, and the toner is supplied to the developer, depending on a reduction in the measured toner density TD (%), wherein the toner is supplied to the developer so that the measured toner density TD (%) falls within a range specified by an expression (1) below, where a number average diameter of the magnetic carrier is represented by Dcav_pop (μm), a number average diameter of the toner is represented by Dtav_pop (μm), a specific gravity of the magnetic carrier is represented by γc, and a specific gravity of the toner is represented by γt.

$$TD\leqq\{\gamma t\cdot Vt/Nt/(\gamma c\cdot Vc)\}\times 100$$

$$Vt=(\pi/6)\cdot(Dtav_pop)^3$$

$$Sc=\pi\cdot(Dcav_pop+Dtav_pop)^2$$

$$Nt=Sc/[(3^{0.5}/2)\cdot(Dtav_pop)^2]/2$$

$$Vc=(\pi/6)\cdot(Dcav_pop)^3 \quad (1)$$

The present invention also provides a development method in which, while stirring a developer which is a mixture of a magnetic carrier and a toner and supplying the toner of the developer, a toner density TD (%) of the developer is measured, and the toner is supplied to the developer, depending on a reduction in the measured toner density TD (%), wherein the toner is supplied to the developer so that the measured toner density TD (%) falls within a range specified by an expression (2) below, where a volume average diameter of the magnetic carrier is represented by Dcav_vol (μm), a volume average diameter of the toner is represented by Dtav_vol (μm), a specific gravity of the magnetic carrier is represented by γc, and a specific gravity of the toner is represented by γt.

$$TD\leqq\{\gamma t\cdot Vt/Nt/(\gamma c\cdot Vc)\}\times 100$$

$$Vt=(\pi/6)\cdot(Dtav_vol)^3$$

$$Sc=\pi\cdot(Dcav_vol+Dtav_vol)^2$$

$$Nt=Sc/[(3^{0.5}/2)\cdot(Dtav_vol)^2]/2$$

$$Vc=(\pi/6)\cdot(Dcav_\mathrm{vol})^3 \quad (2)$$

The present invention also provides a development method in which, while stirring a developer which is a mixture of a magnetic carrier and a toner and supplying the toner of the developer, a toner density TD (%) of the developer is measured, and the toner is supplied to the developer, depending on a reduction in the measured toner density TD (%), wherein the toner is supplied to the developer so that the measured toner density TD (%) falls within a range specified by an expression (3) below, where a volume average diameter of the magnetic carrier is represented by Dcav_vol (μm), and a volume average diameter of the toner is 5.5 (μm).

$$TD\leqq[5.1(Dcav_vol)^{-1.17}]\times 100 \quad (3)$$

The present invention also provides a development method in which, while stirring a developer which is a mixture of a magnetic carrier and a toner and supplying the toner of the developer, a toner density TD (%) of the developer is measured, and the toner is supplied to the developer, depending on a reduction in the measured toner density TD (%), wherein the toner is supplied to the developer so that the measured toner density TD (%) falls within a range specified by an expression (4) below, where a volume average diameter of the magnetic carrier is represented by Dcav_vol (μm), and a volume average diameter of the toner is represented by Dtav_vol (μm).

$$TD/(Dtav_vol)^{1.2}\leqq[5.1(Dcav_vol)^{-1.17}/5.5^{1.2}]\times 100 \quad (4)$$

In the present invention, the toner is preferably a toner produced by a pulverizing method.

The toner preferably has a diameter distribution with a standard deviation σ of 15 (%) or more.

The toner preferably has a pigment concentration of 5 (%) or more.

EFFECTS OF THE INVENTION

The expression (1) or (2) in the development method of the present invention is used to derive a theoretically appropriate toner density. According to the experiment conducted by the inventor(s) of the present invention and the like, it was found that, when the number average diameter Dcav_pop (μm) of a magnetic carrier and the number average diameter Dtav_pop (μm) of a toner, or the volume average diameter Dcav_vol (μm) of a magnetic carrier and the volume average diameter Dtav_vol (μm) of a toner are used to calculate the upper limit value (TD100%={γt·Vt/Nt/(γc·Vc)}×100) of appropriate toner density based on the right-hand side of the expression (1) or (2), the calculated upper limit value of appropriate toner density substantially matches an actual upper limit value of appropriate toner density. Therefore, if the number average diameter Dcav_pop (μm) of a magnetic carrier and the number average diameter Dtav_pop (μm) of a toner, or the volume average diameter Dcav_vol (μm) of a magnetic carrier and the volume average diameter Dtav_vol (μm) of a toner are used to calculate a specified range within which a measured toner density TD (%) should fall, based on the expression (1) or (2) as in the present invention, the specified range can be correctly set, thereby making it possible to consistently appropriately control the toner density. Thereby, occurrence of a faint image, a fog image, or the like can be prevented.

When the volume average diameter Dcav_vol (μm) of a magnetic carrier and the volume average diameter Dtav_vol (μm) of a toner are used, a specified range within which a measured toner density TD (%) should fall can be set based on the expression (3) which is simpler than the expression (1) or (2) if the volume average diameter Dtav_vol (μm) of the toner is specified to be 5.5 (μm).

When the volume average diameter Dtav_vol (μm) of a toner is in the vicinity of 5.5 (μm), a specified range within which a measured toner density TD (%) should fall can be set based on the expression (4) which is simpler than the expression (1) or (2) using the volume average diameter Dcav_vol (μm) of a magnetic carrier and the volume average diameter Dtav_vol (μm) of the toner.

When a toner is produced by the pulverizing method, a diameter of the toner has a broad distribution, so that the number average diameter, the volume average diameter, the number median diameter, the volume median diameter, and the like vary significantly. Specifically, errors in the number median diameter and the volume median diameter with respect to an actual average diameter of the toner are large, and an error in the number average diameter Dtav_pop (μm) or the volume average diameter Dtav_vol (μm) of the toner with respect to the actual average diameter of the toner is small. Therefore, the present invention is more effective.

When the toner diameter distribution has a standard deviation σ of 15 (%) or more, it can be said that the toner diameter distribution is broad, and the number average diameter, the volume average diameter, the number median diameter, the volume median diameter, and the like vary significantly. Therefore, the present invention which employs the number average diameter Dtav_pop (μm) or the volume average diameter Dtav_vol (μm) of a toner is effective.

When the toner has a pigment concentration of 5 (%) or more, fog is significant even if the amount of attached toner is the same, as compared to when the pigment concentration is 5 (%) or less. Therefore the present invention is effective.

BRIEF DESCRIPTION OF DRAWINGS

FIG. 6 is a table indicating a degree of fog BG, an image density IDbk, and an excess toner ratio, which were actually measured with respect to toner densities.

FIG. 7 is a table indicating an upper limit value TD100% of appropriate toner density which is calculated for each of various combinations of a volume average diameter Dcav_vol, a number average diameter Dcav_pop, a volume median diameter Dc50_vol, and a volume median diameter Dc50_vol of a magnetic carrier, and a volume average diameter Dtav_vol, a number average diameter Dtav_pop, a volume median diameter Dt50_vol, and a number median diameter Dt50_vol of a toner.

DESCRIPTION OF REFERENCE NUMERALS

Figure 1:
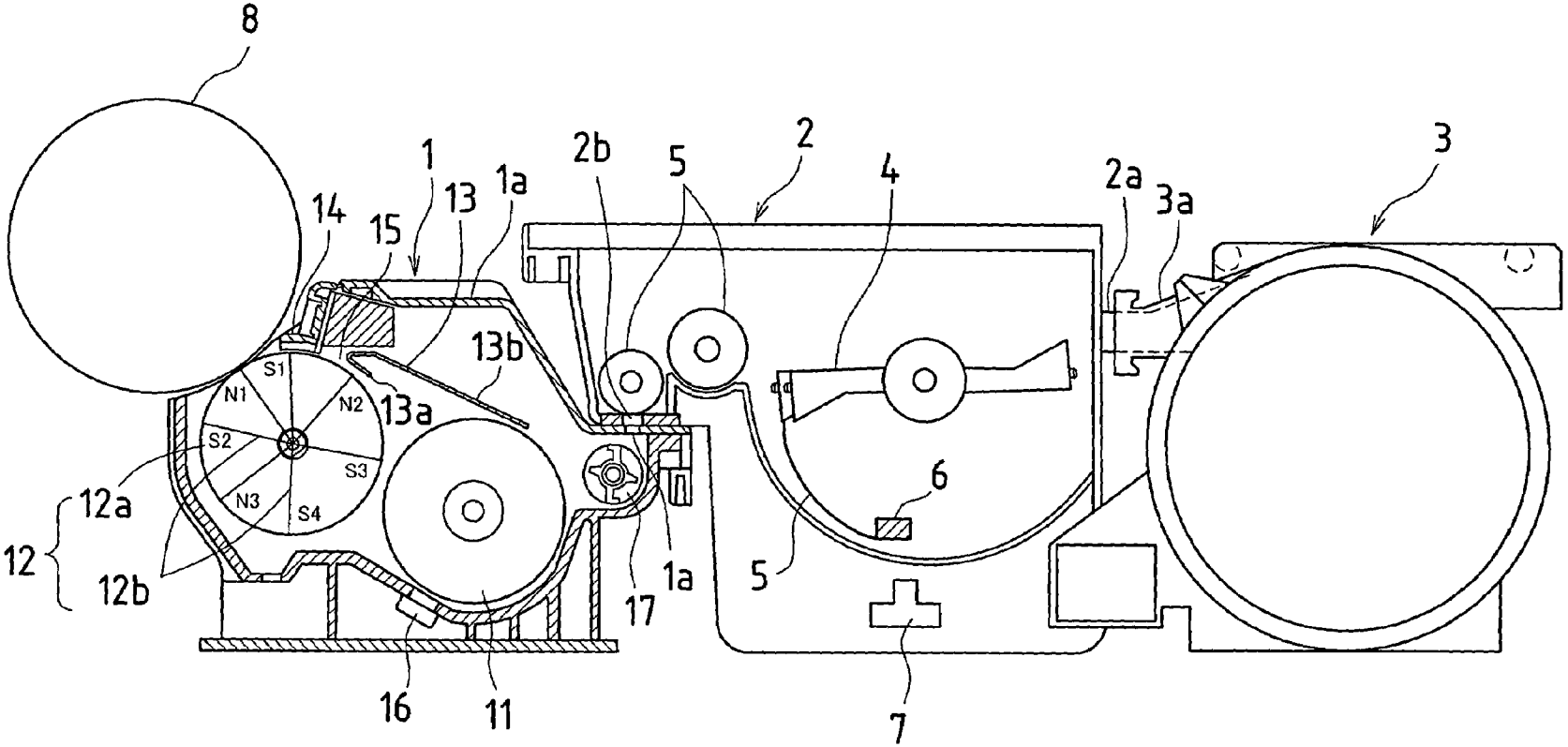
FIG. 1 is a side view of an example of a development apparatus according to the present invention.

1 development apparatus
2 middle hopper
3 toner bottle
4 stirring member
5 flexible band-like member
6 detected material
7 capacitance sensor
8 photosensitive drum
11 stirring roller
12 magnet roller
13 second regulation member
14 first regulation member
15 reflux opening
16 toner density sensor

BEST MODE FOR CARRYING OUT THE INVENTION

Hereinafter, embodiments of the present invention will be described in detail with reference to the accompanying drawings.

EXAMPLES

FIG. 1 is a side view of an example of a development apparatus according to the present invention. The development apparatus 1 of the example is incorporated in an electrophotographic image forming apparatus, in which the development apparatus 1 is linked to a middle hopper 2, and the middle hopper 2 is linked to a toner bottle 3.

The toner bottle 3 holds a toner, and can supply the toner via toner supply paths 3*a* and 2*a* to the middle hopper 2 little by little and stop supply of the toner.

The middle hopper 2 temporarily stores a toner supplied from the toner bottle 3, and supplies the toner via toner supply paths 2*b* and 1*a* to the development apparatus 1. In the middle hopper 2, a stirring member 4 is rotated to stir the toner in the middle hopper 2, and supply rollers 5 and 5 are rotated to move the toner in the middle hopper 2 to the toner supply paths 2*b* and 1*a*. A flexible band-like member 5 is linked to an end of the stirring member 4, and fixedly supports a detected material 6 at a tip thereof. A capacitance sensor 7 is fixed to a bottom of the middle hopper 2, and detects a capacitance between the capacitance sensor 7 and the detected material 6 provided at the tip of the flexible band-like member 5.

In this situation, when the toner decreases in the middle hopper 2, a portion in the vicinity of the tip of the flexible band-like member 5 slides on a surface of the toner, and the detected material 6 also slides on the surface of the toner. When a height of the toner surface decreases due to the decrease in the toner in the middle hopper 2, a position of the detected material 6 sliding on the toner surface also gradually decreases, so that a distance between the detected material 6 sliding on the toner surface and the capacitance sensor 7 becomes shorter. In this case, at the time when the detected material 6 moves immediately above the capacitance sensor 7, the capacitance sensor 7 detects a capacitance between the capacitance sensor 7 and the detected material 6, calculates a distance between the capacitance sensor 7 and the detected material 6 corresponding to the capacitance, and calculates a remaining amount of the toner corresponding to the distance. Thereafter, depending on a reduction in the remaining amount of the toner, the toner is supplied from the toner bottle 3 to the middle hopper 2, or a report is issued which prompts the user to change toner bottles.

The development apparatus 1 holds, in a case 1*a*, a developer which is a mixture of a magnetic carrier and a toner, and supplies the toner of the developer to a photosensitive drum 8 of the image forming apparatus to develop an electrostatic latent image on a surface of the photosensitive drum 8, thereby forming a visible image on the surface of the photosensitive drum 8. In the development apparatus 1, a stirring roller 11 is rotated to stir the developer so that the magnetic carrier and the toner are charged by friction due to the stirring operation, thereby providing electric charge to the magnetic carrier and the toner.

A magnet roller 12 is composed of a rod-shaped multipolar magnetized magnet 12*b* and a sleeve 12*a*. The magnet 12*b* is fixed, and the sleeve 12*a*, which is made of a non-magnetic material (e.g., aluminum), is supported around the magnet 12*b* in a manner which allows the sleeve 12*a* to freely rotate around the magnet 12*b*. The developer is attracted by an outer circumferential surface of the rotating sleeve 12*a* due to the magnetic force of the magnet. In association with rotation of the sleeve 12*a*, a tip 13*a* of a second regulation member 13 regulates the layer thickness of the developer on the outer circumferential surface of the sleeve 12*a*. Further, a first regulation member 14 regulates the layer thickness of the developer on the outer circumferential surface of the sleeve 12*a* again. Thereafter, the developer layer on the outer circumferential surface of the sleeve 12*a* is transported to approach the surface of the photosensitive drum 8.

When charged by friction due to the stirring operation of the stirring roller 11, the toner of the developer layer on the outer circumferential surface of the sleeve 12*a* is charged to a polarity reverse to the electrostatic latent image on the surface of the photosensitive drum 8. Therefore, when the developer layer on the outer circumferential surface of the sleeve 12*a* approaches the surface of the photosensitive drum 8, the toner of the developer layer is attached to the electrostatic latent image on the photosensitive drum 8, so that the electrostatic latent image becomes a visible image.

An excess developer occurs due to layer thickness regulation by the first regulation member 14. The excess developer flows into a reflux opening 15, slides down on a rear surface 13*b* of the second regulation member 13, and is returned to the stirring roller 11.

A well-known toner density sensor 16 is provided on a bottom of the case 1*a* of the development apparatus 1. The toner density sensor 16 is, for example, a magnetic permeability sensor which detects a toner density corresponding to a magnetic permeability of the developer. The developer is a mixture of a non-magnetic material toner and a magnetic carrier. Therefore, as a toner amount per unit volume of the developer increases, a magnetic carrier amount per unit volume decreases, so that a magnetic resistance of the developer increases. Conversely, as the toner amount per unit volume decreases, the magnetic carrier amount per unit volume increases, so that the magnetic resistance of the developer decreases. The toner density sensor 16 detects the magnetic resistance of the developer, thereby detecting the toner amount per unit volume (i.e., toner density) corresponding to the magnetic resistance.

Figure 2:
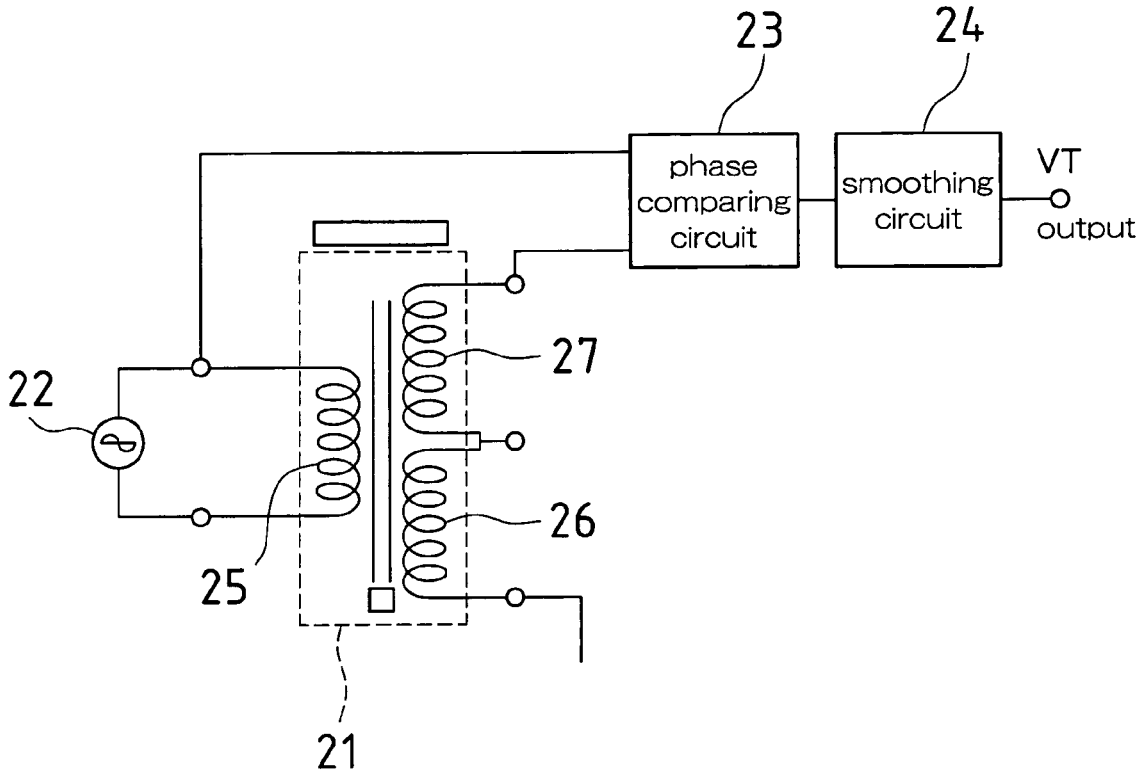
FIG. 2 is a block diagram illustrating a configuration of a toner density sensor in the development apparatus of FIG. 1.

FIG. 2 is a block diagram illustrating a configuration of the toner density sensor 16. Here, the toner density sensor 16 comprises a differential transformer 21, an alternating-current power supply 22, a phase comparing circuit 23, and a smoothing circuit 24.

The differential transformer 21 is composed of a primary coil 25, and secondary coils (a reference coil 26 and a detection coil 27) connected in series. An alternating voltage is applied from the alternating-current power supply 22 to the primary coil 25. The reference coil 26 and the detection coil 27 have substantially the same number of turns, and polarities reverse to each other.

The primary coil 25 and the detection coil 27 are provided in the vicinity of the developer in the case 1*a*. Therefore, the developer functions as a magnetic core for the primary coil 25 and the detection coil 27, and the magnetic resistance of the developer determines an inductance of each of the coils 25 and 27, whereby a voltage signal of the detection coil 27 is determined. Therefore, the voltage signal of the detection coil 27 corresponds to the toner density of the developer.

The phase comparing circuit 23 receives a voltage signal of the primary coil 25 and the voltage signal of the detection coil 27, calculates an logical exclusive OR of these voltage signals, and outputs a signal indicating the logical exclusive OR. When receiving the signal indicating the logical exclusive OR, the smoothing circuit 24 smoothes the signal indicating the exclusive logical OR to output a direct voltage VT. The direct voltage VT, which indicates the toner density, is output as a detection output of the toner density sensor 16.

For the toner density of the developer in the case 1*a*, a target specified range is previously determined. In order to cause the toner density of the developer in the case 1*a* which is detected by the toner density sensor 16 to fall within the specified range, a supply roller 17 of the development apparatus 1 is rotated so that the toner is supplied from the middle hopper 2 via the toner supply paths 2*b* and 1*a* to the case 1*a* of the development apparatus 1.

In such a development apparatus 1, even when actual measurement of the toner density is correct, the toner density of the developer is always inappropriate if there is an error in the target specified range of the toner density, so that a faint image, a fog image, or the like occurs. As described above, conventionally, the target specified range of the toner density is set using an average diameter of the toner and an average diameter of the magnetic carrier. However, if there is an error in the average diameter of the toner and the average diameter of the magnetic carrier, the target specified range is not correctly set, so that the reproduction of appropriate control of toner density is not guaranteed.

Therefore, in the example, the toner is supplied to the developer so that a measured toner density TD (%) falls within a range specified by an expression (2) below, where a volume average diameter of the magnetic carrier is represented by Dcav_vol (μm), a volume average diameter of the toner is represented by Dtav_vol (μm), a specific gravity of the magnetic carrier is represented by γc, and a specific gravity of the toner is represented by γt.

$$TD \leqq \{\gamma t \cdot Vt / Nt / (\gamma c \cdot Vc)\} \times 100$$

$$Vt \text{ (volume of toner)} = (\pi/6) \cdot (Dtav_vol)^3$$

$$Sc \text{ (surface area of magnetic carrier)} = \pi \cdot (Dcav_vol + Dtav_vol)^2$$

$$Nt \text{ (linear density)} = Sc / [(3^{0.5}/2) \cdot (Dtav_vol)^2]/2$$

$$Vc \text{ (volume of magnetic carrier)} = (\pi/6) \cdot (Dcav_vol)^3 \quad (2)$$

If the specified range within which the measured toner density TD (%) should fall is set based on the expression (2) using the volume average diameter Dcav_vol (μm) of the magnetic carrier and the volume average diameter Dtav_vol (μm) of the toner, the target specified range can be correctly set, thereby making it possible to consistently appropriately control the toner density. Thereby, occurrence of a faint image, a fog image, or the like can be prevented.

Next, a reason why the target specified range of the toner density thus obtained is correct will be described.

Figure 3:
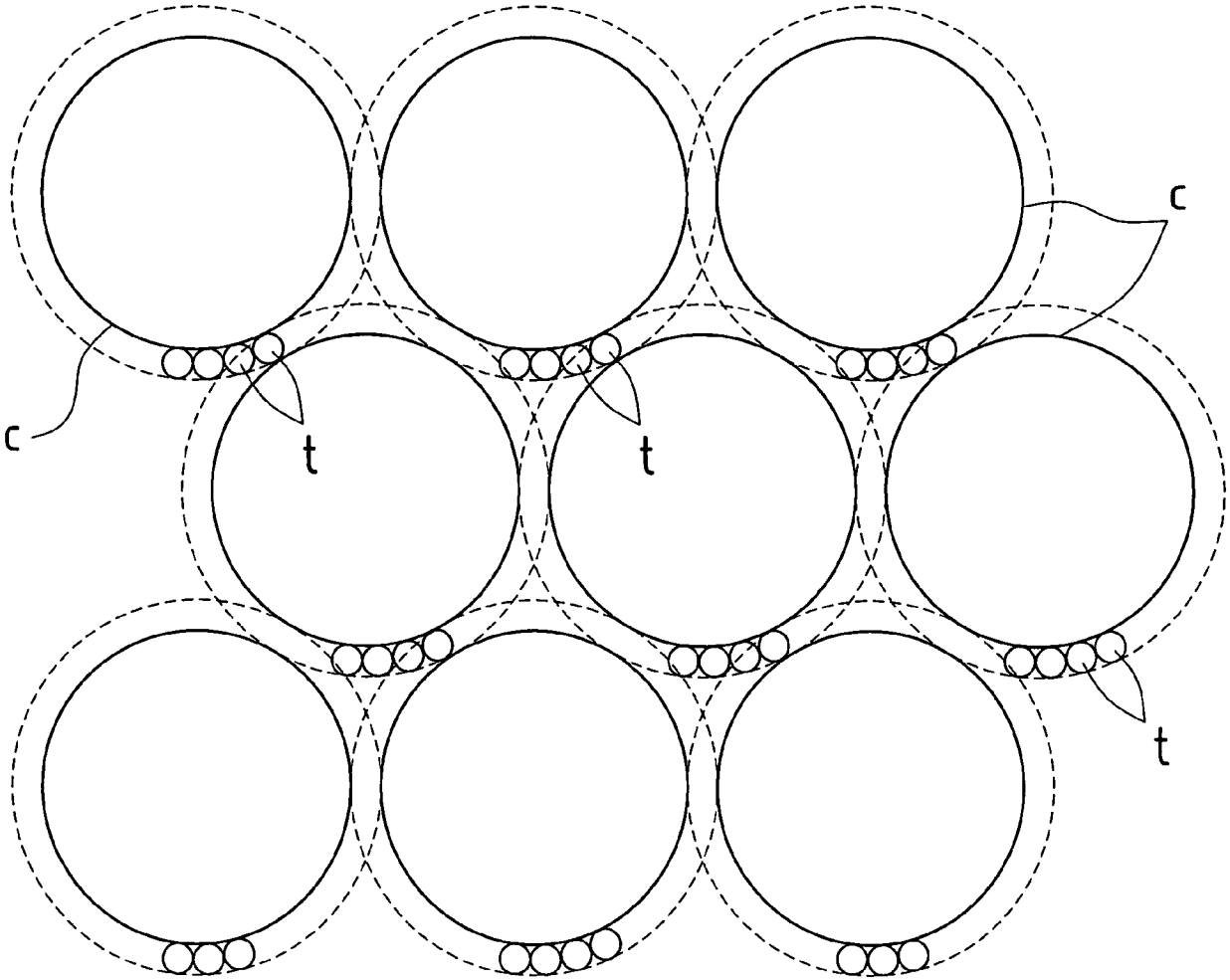
FIG. 3 is a diagram schematically illustrating a situation that a toner is attached to a magnetic carrier.

Firstly, it is assumed that a magnetic carrier c has a larger spherical shape and a toner t has a smaller spherical shape as illustrated in FIG. 3. In addition, it is assumed that appropriate toner density has an upper limit value TD100% when a number of the toners t are attached onto a surface of the magnetic carrier c, so that the surface of the magnetic carrier c is completely covered, i.e., there is no room for attachment of more toners on the surface of the magnetic carrier c, and excess toner which is not attached to the surface of the magnetic carrier c is absent.

In the situation of FIG. 3, the upper limit value TD100% of appropriate toner density can be theoretically calculated by an expression (5) below, where the volume average diameter of the magnetic carrier is represented by Dcav_vol (μm), the volume average diameter of the toner is represented by Dtav_vol (μm), the specific gravity of the magnetic carrier is represented by γc, and the specific gravity of the toner is represented by γt.

$$TD100\% = \{\gamma t \cdot Vt / Nt / (\gamma c \cdot Vc)\} \times 100 \quad (5)$$

The right-hand side of the expression (2) is the same as the right-hand side of the expression (5). Therefore, the expression (2) suggests that the toner density TD (%) is caused to consistently approach to the upper limit value TD100% while the measured toner density TD (%) is kept smaller than or equal to the upper limit value TD100% of appropriate toner density of the expression (5).

If there is excess toner t, the measured toner density TD (%) does not fall within the specified range of the expression (2). In this case, the excess toner t is supplied from the magnet roller 12 to the photosensitive drum 8, resulting in a fog image.

On the other hand, developers having various toner densities TD (%) were produced using a developer which is a mixture of a magnetic carrier having a volume average diameter Dcav_vol of 45 (μm) and a specific gravity γc of about 5 and a toner having a volume average diameter Dtav_vol of 5.5 (μm) and a specific gravity γt of about 1 while adjusting as appropriate the amounts of the magnetic carrier and the toner when the magnetic carrier and the toner were mixed. These developers were used to form respective images and study fogs in these images, so that results were obtained as illustrated in graphs of FIGS. 4(*a*), 4(*b*), and 4(*c*).

Figure 4:
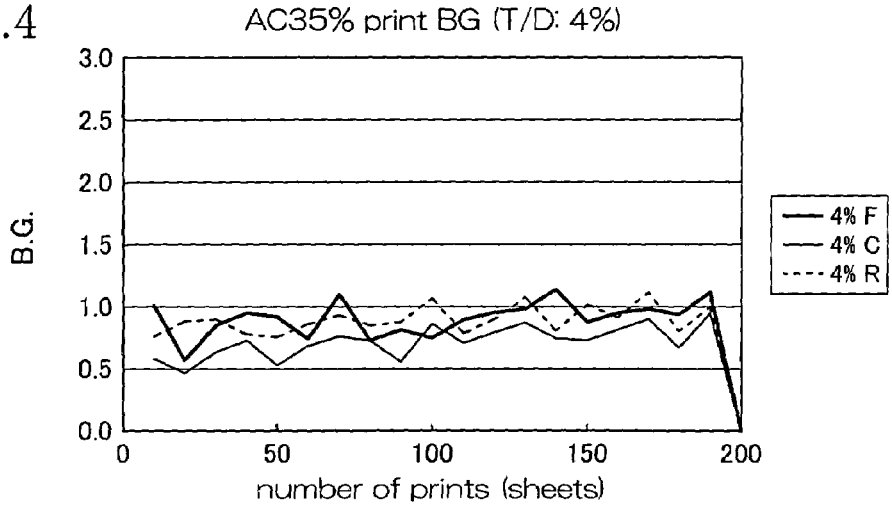
FIGS. 4(*a*), 4(*b*), and 4(*c*) are graphs indicating a degree of fog BG of an image when a toner density TD=4 (%), a degree of fog BG of an image when a toner density TD=5 (%), and a degree of fog BG of an image when a toner density TD=6 (%), respectively.
Figure 4:
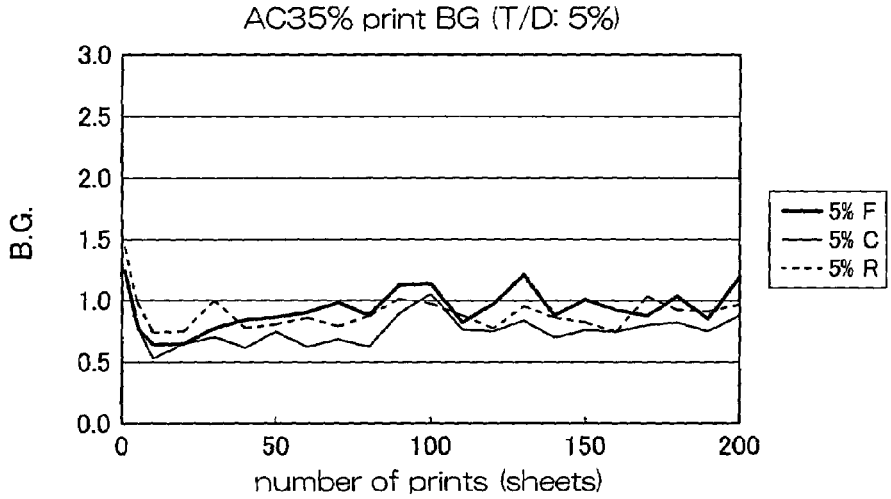
Figure 4:
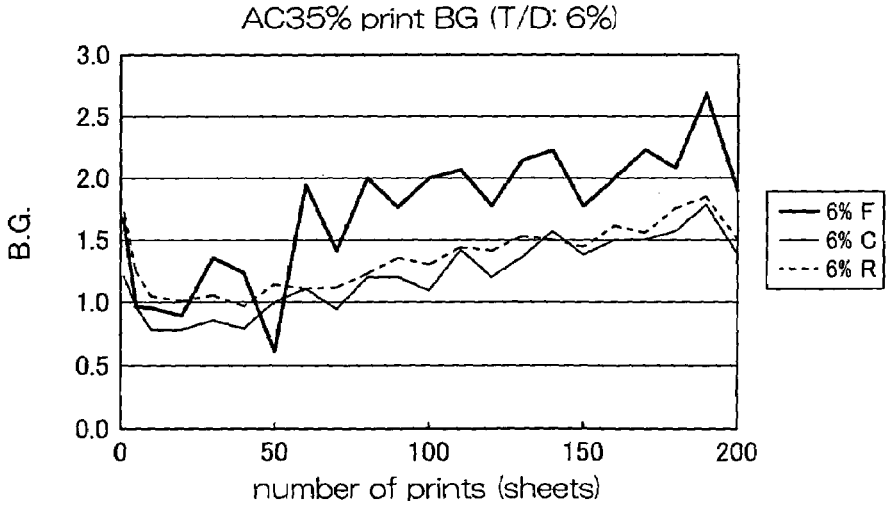

FIGS. 4(*a*), 4(*b*), and 4(*c*) are graphs indicating a degree of fog BG of an image when the toner density TD=4 (%), a degree of fog BG of an image when the toner density TD=5 (%), and a degree of fog BG of an image when the toner density TD=6 (%), respectively. Note that, in these graphs, the horizontal axis indicates the number of prints of an image, and the vertical axis indicates the degree of fog BG of the image. Characteristics curves F, C, and R indicate a degree of fog BG in a front portion of the image, a degree of fog BG in a middle portion of the image, and a degree of fog BG in a rear portion of the image, respectively.

As can be seen from comparison of the graphs of FIGS. 4(*a*), 4(*b*), and 4(*c*), the degree of fog BG of the image is small until at least the toner density TD=5 (%), and the degree of fog BG is large at the toner density TD=6(%). Therefore, the upper limit value TD100% of appropriate toner density is in the range of 5 (%) to 6 (%).

Figure 5:
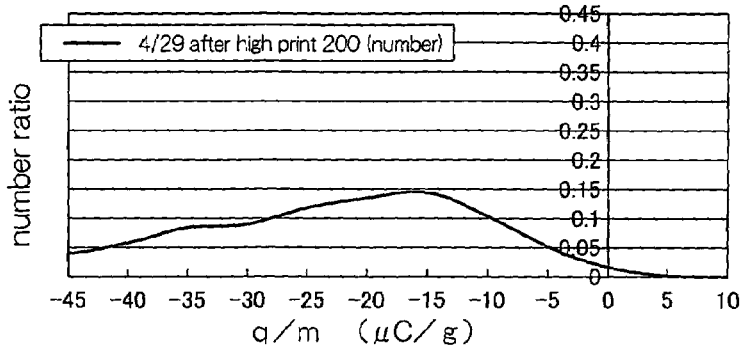
FIGS. 5(*a*), 5(*b*), 5(*c*) and 5(*d*) are graphs indicating a distribution of a charge amount q/m of a toner when the toner density TD=4 (%), a distribution of a charge amount q/m of the toner when the toner density TD=5 (%), a distribution of a charge amount q/m of the toner when the toner density TD=6 (%), and a distribution of a charge amount q/m of the toner when the toner density TD=5.6 (%), respectively.
Figure 5:
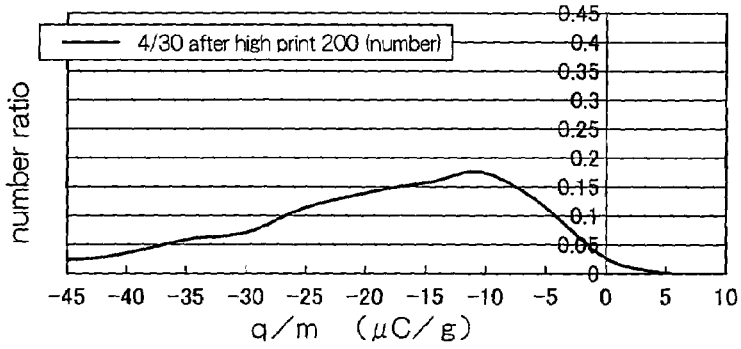
Figure 5:
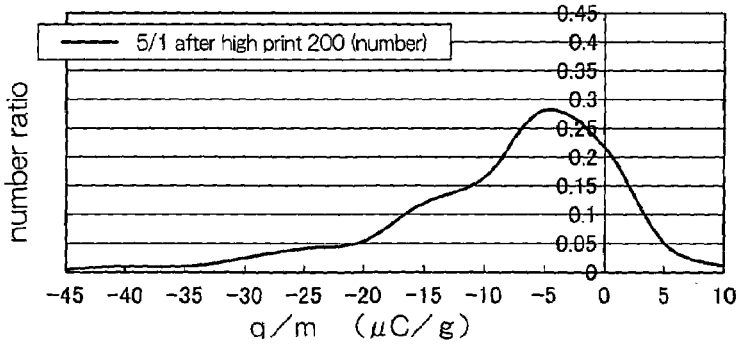
Figure 5:
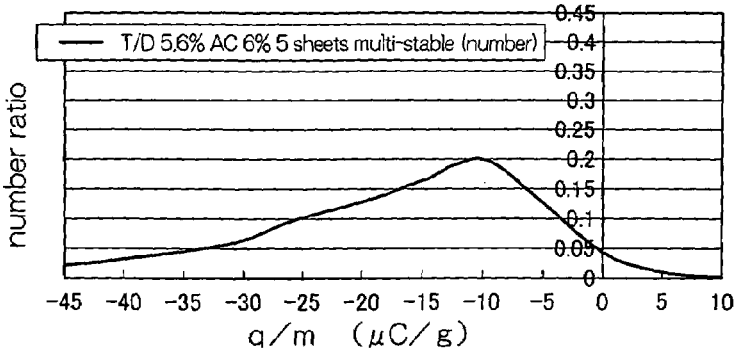

FIGS. 5(*a*), 5(*b*), and 5(*c*) correspond to FIGS. 4(*a*), 4(*b*), and 4(*c*), respectively. FIGS. 5(*a*), 5(*b*), and 5(*c*) are graphs indicating a distribution of a charge amount q/m of the toner when the toner density TD=4 (%), a distribution of a charge amount q/m of the toner when the toner density TD=5 (%), and a distribution of a charge amount q/m of the toner when the toner density TD=6 (%), respectively. Note that, in these graphs, the horizontal axis indicates the charge amount q/m of the toner, and the vertical axis indicates the number of toners.

As can be seen from comparison of the graphs of FIGS. 5(*a*), 5(*b*), and 5(*c*), substantially all of the toner is normally charged until at least the toner density TD=5 (%), and when the toner density TD=6 (%), a large portion of the toner is charged to a reverse polarity (+). This is because there is no excess toner until at least the toner density TD=5 (%), so that the magnetic carrier and the toner are normally charged by friction, however, when the toner density TD=6 (%), excess toner occurs, so that the toner is charged to the reverse polarity since triboelectrification occurs between the toners.

Therefore, when a number of toners t are attached to the surface of the magnetic carrier c, so that the surface of the magnetic carrier c is completely covered, and excess toner which is not attached onto the surface of the magnetic carrier c is absent as illustrated in FIG. 3, it can be said that the upper limit value TD100% of appropriate toner density is set. When there is excess toner, fog will occur.

Further, the degree of fog BG of an image was examined while the amount of a magnetic carrier and the amount of a toner were appropriately adjusted when the magnetic carrier and the toner were mixed so that the toner density TD was changed from 5.1 (%) to 5.9 (%) in units of 0.1 (%), though the result is not herein shown in the graphs. As a result, it was found that the upper limit value TD100% of appropriate toner density is 5.6 (%).

FIG. 5(*d*) is a graph indicating a distribution of the charge amount q/m of a toner when the toner density TD=5.6 (%). As can be seen from this graph, when the toner density TD=5.6 (%), substantially all of the toner is normally charged and there is no excess toner.

FIG. 6 is a table indicating a degree of fog BG, an image density IDbk, and an excess toner ratio, which were actually measured, with respect to toner densities. As can be seen from this table, until the toner density TD=5.6 (%), the degree of fog BG is small and there is no excess toner; and when the toner density TD=6.0 (%), the degree of fog BG is large and there is excess toner.

As described above, it was found that, when a developer which is a mixture of a magnetic carrier having a volume average diameter Dcav_vol of 45 (μm) and a specific gravity γc of about 5 and a toner having a volume average diameter Dtav_vol of 5.5 (μm) and a specific gravity γt of about 1 is used, the upper limit value TD100% of appropriate toner density is 5.6 (%).

Therefore, when the volume average diameter Dcav_vol=45 (μm) of the magnetic carrier, the volume average diameter Dtav_vol=5.5 (μm) of the toner, the specific gravity γt=1 of the toner, and the specific gravity γc=5 of the magnetic carrier are substituted into the right-hand side of the expression (2) to calculate the upper limit value TDma of the appropriate toner density, 5.6 (%) is obtained. The upper limit value TD100% of the appropriate toner density obtained by the experiment matches the upper limit value TD100% of appropriate toner density calculated by the expression (2). Therefore, by using the volume average diameter Dcav_vol of a magnetic carrier and the volume average diameter Dtav_vol of a toner, a specified range within which a measured toner density TD (%) should fall can be correctly set, thereby making it possible to consistently appropriately control the toner density.

As described above, examples of a method for determining an average diameter of a particle includes, in addition to volume average diameter, number average diameter, number median diameter, volume median diameter, and the like. However, these diameters differ from each other even for the same toner or magnetic carrier.

For example, whereas the volume average diameter Dcav_vol of a magnetic carrier is 45 (μm) and the volume average diameter Dtav_vol of a toner is 5.5 (μm), the number average diameter Dcav_pop of the magnetic carrier is 42 (μm) and the number average diameter Dtav_pop of the toner is 4.8 (μm).

Also when the number average diameter is used, a toner may be supplied to a developer so that a measured toner density TD (%) falls within a range specified by an expression (1) below, in a manner similar to that of the volume average diameter, where the number average diameter of the magnetic carrier is represented by Dcav_pop (μm), the number average diameter of the toner is represented by Dtav_pop (μm), the specific gravity of the magnetic carrier is represented by γc, and the specific gravity of the toner is represented by γt.

$$TD \leqq \{\gamma t \cdot Vt/Nt/(\gamma c \cdot Vc)\} \times 100$$

$$Vt = (\pi/6) \cdot (Dtav_pop)^3$$

$$Sc = \pi \cdot (Dcav_pop + Dtav_pop)^2$$

$$Nt = Sc/[(3^{0.5}/2) \cdot (Dtav_pop)^2]/2$$

$$Vc = (\pi/6) \cdot (Dcav_pop)^3 \quad (1)$$

When the number average diameter Dcav_pop=42 (μm) of the magnetic carrier, the number average diameter Dtav_pop=4.8 (μm) of the toner, the specific gravity γt=1 of the toner, and the specific gravity γc=5 of the magnetic carrier are substituted into the right-hand side of the expression (1) to calculate the upper limit value TDma of the appropriate toner density, 5.5 (%) is obtained. The upper limit value TD100% of the appropriate toner density obtained by the experiment substantially matches the upper limit value TD100% of appropriate toner density calculated by the expression (1).

Therefore, even when the number average diameter is used instead of the volume average diameter, a specified range within which a measured toner density TD (%) should fall can be correctly set, thereby making it possible to consistently appropriately control the toner density.

When the volume average diameter Dcav_vol of the magnetic carrier is 45 (μm) and the volume average diameter Dtav_vol of the toner is 5.5 (μm), the volume median diameter Dc50_vol of the magnetic carrier is 48 (μm) and the number median diameter Dt50_vol of the toner is 6.7 (μm). If the volume median diameter Dc50_vol=48 (μm) and the number median diameter Dt50_vol=6.7 (μm) of the toner are substituted into the right-hand side of the expression (2) instead of the volume average diameter Dcav_vol and volume average diameter Dtav_vol to calculate the upper limit value TDma of the appropriate toner density, 6.6 (%) is obtained. However, 6.6 (%) thus calculated significantly deviates from the upper limit value TD100% of appropriate toner density=5.6 (%) obtained by the experiment.

Similarly, the number median diameter Dc50_pop of the magnetic carrier is 40 (μm) and the number median diameter Dt50_pop of the toner is 4.4 (μm). If the number median diameter Dc50_pop=40 (μm) and the number median diameter Dt50_pop=4.4 (μm) are substituted into the right-hand side of the expression (1) instead of the number average diameter Dcav_pop (μm) and the number average diameter Dtav_pop (μm) to calculate the upper limit value TDma of the appropriate toner density, 5.0 (%) is obtained. However, 5.0 (%) thus calculated significantly deviates from the upper limit value TD100% of appropriate toner density=5.6 (%) obtained by the experiment.

Therefore, when the number median diameter or the volume median diameter is used, a specified range within which a measured toner density TD (%) should fall cannot be correctly set, so that the toner density cannot be consistently appropriately controlled.

FIG. 7 is a table indicating the upper limit value TD100% of appropriate toner density which is calculated for each of various combinations of the volume average diameter Dcav_vol, the number average diameter Dcav_pop, the volume median diameter Dc50_vol, and the volume median diameter Dc50_vol of a magnetic carrier, and the volume average diameter Dtav_vol, the number average diameter Dtav_pop, the volume median diameter Dt50_vol, and the number median diameter Dt50_vol of a toner. As can be seen from this table, in the case of the combination of the volume average diameter Dcav_vol of the magnetic carrier and the volume average diameter Dtav_vol of the toner, and in the case of the combination of the number average diameter Dcav_pop of the magnetic carrier and the number average diameter Dtav_pop of the toner, the upper limit value TD100% of appropriate toner density obtained by the calculation matches the upper limit value TD100% of appropriate toner density=5.6 (%) obtained by the experiment. In the case of the other combinations, there is not a match.

Next, the accuracy of the volume average diameter, the number average diameter, the number median diameter, and the volume median diameter was studied in terms of other viewpoints, and the results will be described.

For n particles, a diameter of an i-th particle is represented by di, and a volume average diameter is represented by Dav_vol. In this case, the volume average diameter Dav_vol is defined by an expression (6) below. Similarly, for n particles, a diameter of an i-th particle is represented by di, and a number average diameter is represented by Dav_pop. In this case, the number average diameter Dav_pop is defined by an expression (7) below.

$$\text{Volume average diameter: Dav_vol} = \left[\sum_{i=1}^{n} vi/n\right]^{(1/3)} \quad (6)$$

$$(vi = [di]^3)$$

$$\text{Number average diameter: Dav_pop} = \sum_{i=1}^{n} di/n \quad (7)$$

Therefore, it is considered that the volume average diameter Dav_vol and the number average diameter Dav_pop have normal distributions.

Figure 8:
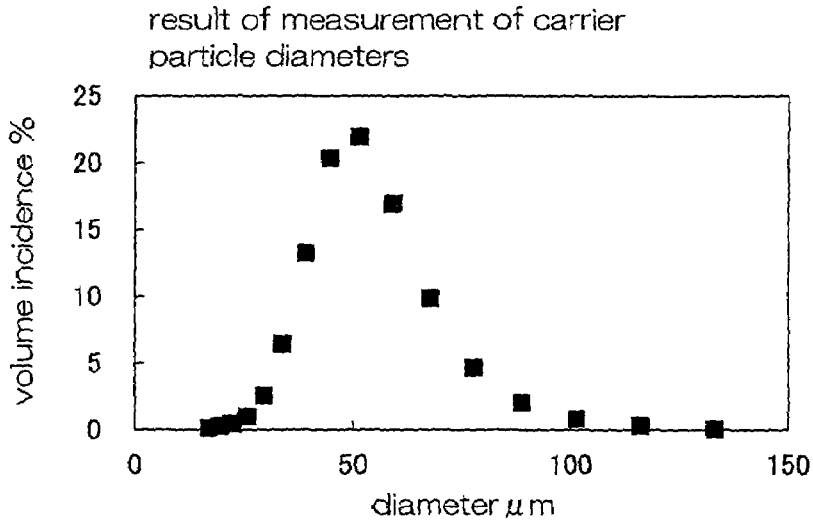
FIG. 8 is a graph indicating a volume incidence with respect to a diameter of a magnetic carrier, which was actually measured.
Figure 9:
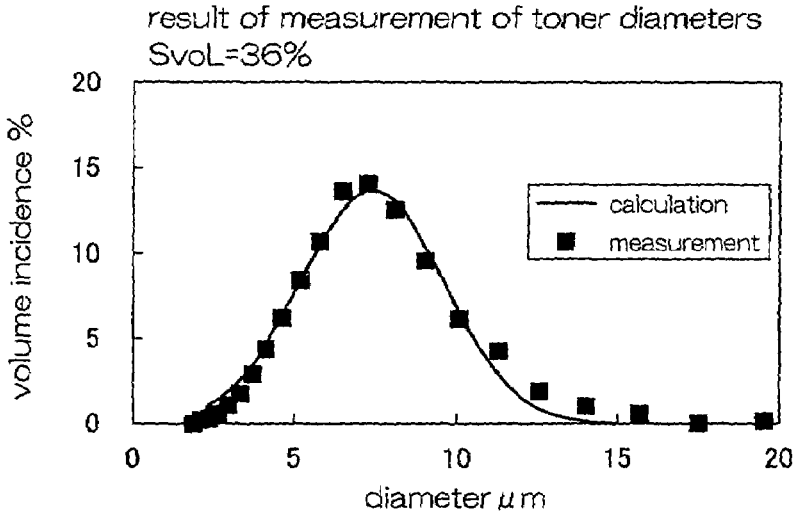
FIG. 9 is a graph indicating a volume incidence with respect to a diameter of a toner, which was actually measured.

On the other hand, FIG. 8 is a graph indicating a volume incidence with respect to the diameter of a magnetic carrier, which was actually measured, and FIG. 9 is a graph indicating a volume incidence with respect to the diameter of a toner, which was actually measured. As can be seen from FIG. 8 and FIG. 9, both the characteristics are considerably approximate to normal distributions (indicated with a solid line in the graph of FIG. 9). Therefore, it can be said that, even if the diameter of a toner has a broad distribution, errors in the volume average diameter Dcav_vol of the magnetic carrier and the volume average diameter Dtav_vol of the toner are small.

A number incidence with respect to the diameter of a magnetic carrier and a number incidence with respect to the diameter of a toner are considerably approximate to normal distributions, though they are not herein indicated with graphs. Therefore, it can be said that errors in the number average diameter Dcav_pop of the magnetic carrier and the number average diameter Dtav_pop of the toner are small.

When the volume median diameter is represented by D50_vol, the volume median diameter D50_vol is defined by an expression (8) below. Similarly, when the number median diameter is represented by D50_pop, the number median diameter D50_pop is defined by an expression (9). A standard deviation Svol of the volume median diameter D50_vol and a standard deviation Spop of the number median diameter D50_pop are defined by expressions (10) and (11) below.

Volume median diameter: D50_when cumulative volume incidence is 50% (total number=100%) (8)

Number median diameter: D50_pop when cumulative number incidence is 50% (total number=100%) (9)

Volume standard deviation: Svol=SS/D50_vol (10)

Number standard deviation: Spop=SS/D50_pop (11)

$$\left(SS = \left\{[1/(n-1)]\left[\sum_{i=1}^{n} di^2 - (1/n)\left(\sum_{i=1}^{n} di\right)\right]^2\right\}^{(1/2)}\right)$$

Figure 10:
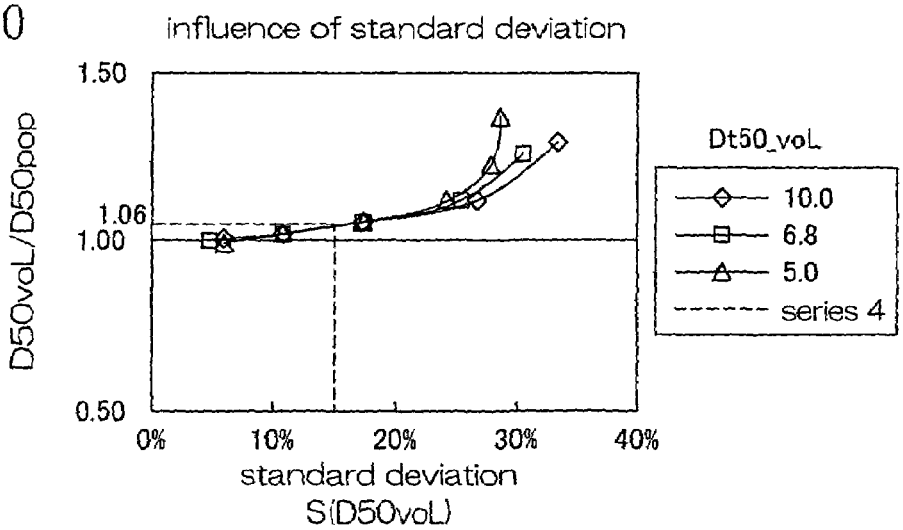
FIG. 10 is a graph indicating characteristics of a ratio of a volume median diameter D50_vol to a number median diameter D50_pop with respect to a standard deviation Svol.

FIG. 10 is a graph indicating characteristics of a ratio of the volume median diameter D50_vol to the number median diameter D50_pop with respect to the standard deviation Svol for three toners having diameter different from each other. In this case, if the volume median diameter D50_vol and the number median diameter D50_pop are correct, the ratio of these is close to 1. In other words, as these become more incorrect, the ratio of these deviates from 1 to more extent. As can be seen from the graph of FIG. 10, if the standard deviation Svol is 15% or more, the ratio of the volume median diameter D50_vol to the number median diameter D50_pop is large, so that it can be said that the volume median diameter D50_vol and the number median diameter D50_pop are incorrect.

Therefore, when the diameter of a toner has a broad distribution and the standard deviation Svol is 15 (%) or more, there are large errors in the number median diameter, the volume median diameter, and the like, so that the use of the number average diameter Dtav_pop (μm) or the volume average diameter Dtav_vol (μm) of a toner is effective.

Note that, when a toner is produced by a pulverizing method of melt-kneading a resin, a colorant, and the like, followed by pulverization and classification, the diameter of the toner has a broad distribution. Therefore, errors in the number median diameter and the volume median diameter with respect to the actual average diameter of the toner are large, and an error in the number average diameter Dtav_pop (μm) or the volume average diameter Dtav_vol (μm) of the toner with respect to the actual average diameter of the toner is small. Therefore, the use of the number average diameter Dtav_pop (μm) or the volume average diameter Dtav_vol (μm) of a toner is more effective.

When a toner has a pigment concentration of 5 (%) or more, fog is significant as compared to when the pigment concentration is less than 5 (%) even if the amount of attached toner is the same. Therefore, the example is effective.

Next, an expression which is simpler than the expression (2) is derived as an expression for setting a specified range within which a measured toner density TD (%) should fall.

Figure 11:
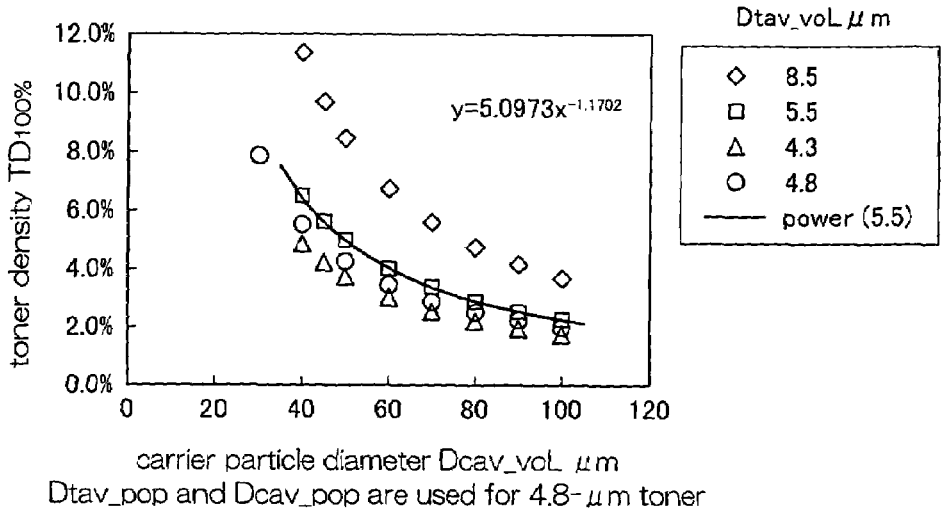
FIG. 11 is a graph indicating characteristics of an upper limit value TD100% of appropriate toner density with respect to a volume average diameter Dcav_vol of a magnetic carrier for each of four toners.

FIG. 11 is a graph indicating characteristics of the upper limit value TD100% of appropriate toner density with respect to the volume average diameter Dcav_vol of a magnetic carrier for each of four toners having a volume average diameter Dtav_vol of 8.5 (μm), 5.5 (μm), 4.8 (μm), and 4.3 (μm). When the characteristics of the volume average diameter Dtav_vol=5.5 (μm) of a toner in the graph of FIG. 11 is selected, an approximate expression for these characteristics is calculated by an expression (3) below.

$$TD \leqq [5.1(Dcav_vol)^{-1.17}] \times 100 \quad (3)$$

Figure 12:
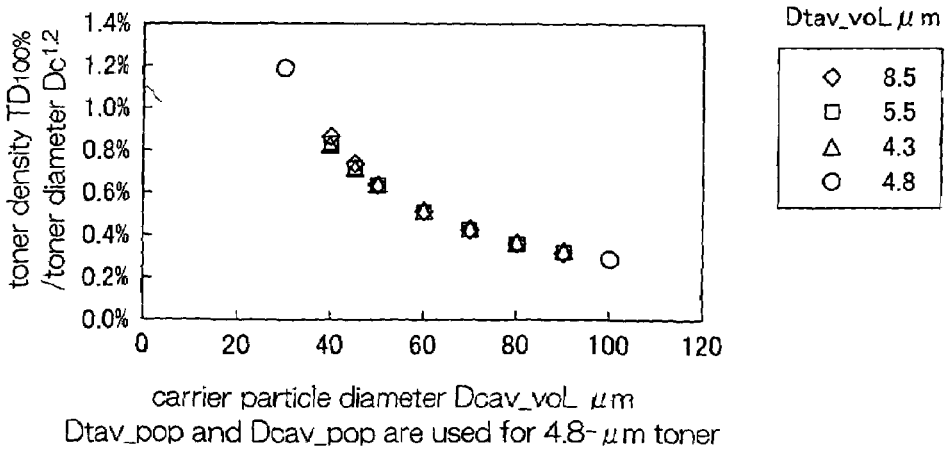
FIG. 12 is a graph indicating a curve obtained by normalization of the characteristics of the four toners of FIG. 11.
Figure 13:
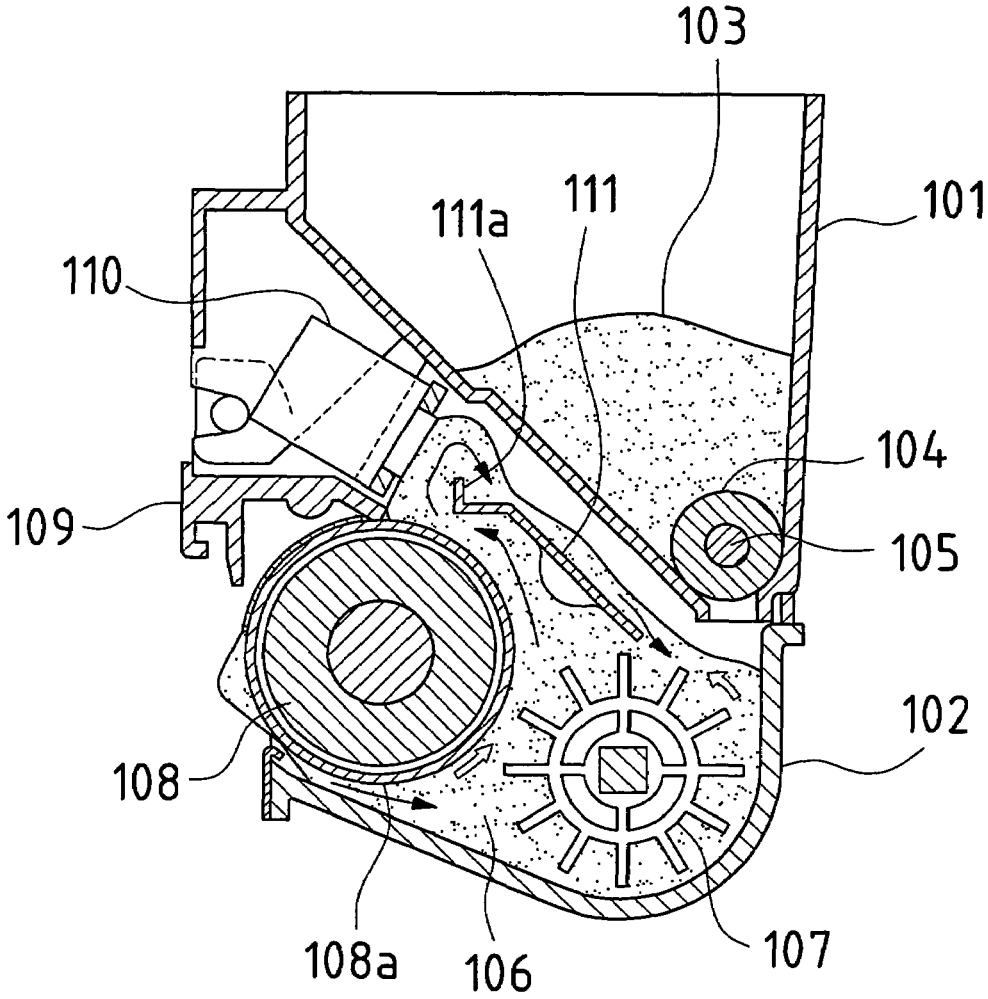
FIG. 13 is a side view of a conventional development apparatus.

If the characteristics of the four toners in the graph of FIG. 11 are normalized by dividing by the volume average diameter Dtav_vol of the respective toners to the power of 1.2, the characteristics of the upper limit value TD100% of appropriate toner density can be converged to a single curve as illustrated in a graph of FIG. 12. An expression (4) below can be derived.

$$TD/(Dcav_vol)^{1.2} \leqq [5.1(Dcav_vol)^{-1.17}/5.5^{1.2}] \times 100 \quad (4)$$

A specified range within which a measured toner density TD (%) should fall may be set based on the expression (3) or (4) which is simpler than the expression (2).

In addition, an expression which is simpler than the expression (1) can be derived as an expression for setting a specified range within which a measured toner density TD (%) should fall.

Also in this case, assuming that the number average diameter Dtav_pop of a toner is 5.5 (μm), an approximate expression below is obtained.

$$TD \leqq [5.1(Dtav_pop)^{-1.17}] \times 100 \quad (A)$$

If it is normalized by dividing the number average diameter Dtav_pop of the toner to the power of 1.2, an expression below can be derived.

$$TD/(Dtav_pop)^{1.2} \leqq [5.1(Dcav_pop)^{-1.17}/5.5^{1.2}] \times 100 \quad (B)$$

A specified range within which a measured toner density TD (%) should fall may be set based on the expression (A) or (B) which is simpler than the expression (1).

Note that the present invention is not limited to the above-described examples and can be embodied in other different forms. For example, the present invention can be applied to a development apparatus having a configuration different from that of FIG. 1. The magnetic carrier diameters and the toner diameters described herein are only for illustrative purposes, and even if they are changed, the present invention is still applicable.

INDUSTRIAL APPLICABILITY

The present invention provides a development method and a development apparatus which are capable of consistently appropriately controlling a toner density by setting a covering ratio of a toner with respect to a carrier in a two-component developer to be within an appropriate range, and are effective for an improvement in image quality.

The invention claimed is:

1. A development method in which, while stirring a developer which is a mixture of a magnetic carrier and a toner and supplying the toner of the developer, a toner density TD (%) of the developer is measured, and the toner is supplied to the developer, depending on a reduction in the measured toner density TD (%), wherein the toner is supplied to the developer so that the measured toner density TD (%) falls within a range specified by:

$$TD \leqq \{\gamma t \cdot Vt/Nt/(\gamma c \cdot Vc)\} \times 100$$

$$Vt = (/6) \cdot (Dtav_pop)^3$$

$$Sc = \cdot (Dcav_pop + Dtav_pop)^2$$

$$Nt = Sc/[(3^{0.5}/2) \cdot (Dtav_pop)^2]/2$$

$$Vc = (/6) \cdot (Dcav_pop)^3 \quad (1)$$

where a number average diameter of the magnetic carrier is represented by Dcav_pop (μm), a number average diameter of the toner is represented by Dtav_pop (μm), a specific gravity of the magnetic carrier is represented by γc, and a specific gravity of the toner is represented by γt.

2. A development method in which, while stirring a developer which is a mixture of a magnetic carrier and a toner and supplying the toner of the developer, a toner density TD (%) of the developer is measured, and the toner is supplied to the developer, depending on a reduction in the measured toner density TD (%), wherein the toner is supplied to the developer so that the measured toner density TD (%) falls within a range specified by:

$$TD \leqq \{\gamma t \cdot Vt/Nt/(\gamma c \cdot Vc)\} \times 100$$

$$Vt = (/6) \cdot (Dtav_vol)^3$$

$$Sc=\cdot(Dcav_vol+Dtav_vol)^2$$

$$Nt=Sc/[(3^{0.5}/2)\cdot(Dtav_vol)^2]/2$$

$$Vc=(/6)\cdot(Dcav_vol)^3 \quad (2)$$

where a volume average diameter of the magnetic carrier is represented by Dcav_vol (μm), a volume average diameter of the toner is represented by Dtav_vol (μm), a specific gravity of the magnetic carrier is represented by γc, and a specific gravity of the toner is represented by γt.

3. A development method in which, while stirring a developer which is a mixture of a magnetic carrier and a toner and supplying the toner of the developer, a toner density TD (%) of the developer is measured, and the toner is supplied to the developer, depending on a reduction in the measured toner density TD (%), wherein the toner is supplied to the developer so that the measured toner density TD (%) falls within a range specified by:

$$TD \leqq [5.1(Dcav_vol)^{-1.17}]\times 100 \quad (3)$$

where a volume average diameter of the magnetic carrier is represented by Dcav_vol (μm), and a volume average diameter of the toner is 5.5 (μm).

4. A development method in which, while stirring a developer which is a mixture of a magnetic carrier and a toner and supplying the toner of the developer, a toner density TD (%) of the developer is measured, and the toner is supplied to the developer, depending on a reduction in the measured toner density TD (%), wherein the toner is supplied to the developer so that the measured toner density TD (%) falls within a range specified by:

$$TD/(Dtav_vol)^{1.2} \leqq [5.1\ (\mathrm{Dcav}_vol)^{-1.17}/5.5^{1.2}]\times 100 \quad (4)$$

where a volume average diameter of the magnetic carrier is represented by Dcav_vol (μm), and a volume average diameter of the toner is represented by Dtav_vol (μm), said Dtav_vol (μm) being in the vicinity of 5.5 (μm).

5. The development method according claim 1, wherein the toner is a toner produced by a pulverizing method.

6. The development method according to claim 1, wherein the toner has a diameter distribution with a standard deviation σ of 15 (%) or more.

7. The development method according to claim 1, wherein the toner has a pigment concentration of 5 (%) or more.

* * * * *